United States Patent [19]

Rosen

[11] Patent Number: 5,035,562

[45] Date of Patent: Jul. 30, 1991

[54] TRI-LEVEL VEHICULAR PARKING APPARATUS

[75] Inventor: Arnold M. Rosen, Bergenfield, N.J.

[73] Assignee: Park Plus Corporation, Hauppauge, N.Y.

[21] Appl. No.: 462,571

[22] Filed: Jan. 9, 1990

[51] Int. Cl.[5] ..... B66F 1/04

[52] U.S. Cl. ..... 414/240; 414/249; 414/228; 187/8.41; 187/17; 254/89 H; 254/93 L

[58] Field of Search ..... 414/227, 228, 231, 232, 414/233, 234, 239, 240, 242, 247, 252, 253, 261, 678; 187/8.41, 8.49, 8.59, 8.50, 8.64, 8.65, 8.71, 95, 8.72, 17; 211/1.5, 169, 169.1, 174; 254/2 R, 2 B, 2 C, 93 L, 89 H

[56] References Cited

U.S. PATENT DOCUMENTS

| | | |
|---|---|---|
| 1,619,360 | 3/1927 | Miller . |
| 1,620,256 | 3/1927 | Heise . |
| 2,242,892 | 5/1941 | Light . |
| 2,280,567 | 4/1942 | Austin . |
| 2,455,507 | 12/1948 | Light . |
| 2,640,562 | 6/1953 | Villars . |
| 2,701,065 | 2/1955 | Bertel . |
| 2,701,654 | 2/1955 | Williamsen . |
| 2,702,606 | 2/1955 | Young . |
| 2,857,985 | 10/1958 | Simmons, Sr. . |
| 3,330,083 | 7/1967 | Jaulmes . |
| 3,387,722 | 6/1968 | Fisher, Sr. et al. . |
| 3,680,718 | 8/1972 | Miyachi . |
| 3,706,356 | 12/1972 | Herbst et al. . |
| 3,750,899 | 8/1973 | Greer . |
| 3,896,941 | 7/1975 | Kuhn et al. . |
| 3,941,257 | 3/1976 | Matsuura . |
| 3,985,207 | 10/1976 | Petit . |
| 4,015,733 | 4/1977 | Woehr, Sr. et al. . |
| 4,167,365 | 9/1979 | Constantinescu . |
| 4,209,276 | 6/1980 | Rosen . |
| 4,455,115 | 6/1984 | Alger et al. . |
| 4,531,614 | 7/1985 | Naegli . |
| 4,551,054 | 11/1985 | Klaus . |
| 4,674,938 | 6/1987 | Van Stokes et al. . |
| 4,772,172 | 9/1988 | Rosen . |
| 4,804,066 | 2/1989 | Fusaro et al. . |
| 4,826,384 | 5/1989 | Okura et al. ..... 414/233 X |

FOREIGN PATENT DOCUMENTS

| | | |
|---|---|---|
| 1193660 | 5/1965 | Fed. Rep. of Germany . |
| 2013384 | 11/1971 | Fed. Rep. of Germany . |
| 2644022 | 4/1978 | Fed. Rep. of Germany . |
| 2651365 | 5/1978 | Fed. Rep. of Germany . |
| 2709203 | 9/1978 | Fed. Rep. of Germany . |
| 1371832 | 8/1964 | France . |
| 1395365 | 3/1965 | France . |
| 140736 | 3/1980 | German Democratic Rep. . |
| 1597361 | 9/1981 | United Kingdom . |
| 2051004 | 3/1983 | United Kingdom . |

*Primary Examiner*—Frank E. Werner

*Attorney, Agent, or Firm*—Anthony J. Casella; Gerald E. Hespos

[57] ABSTRACT

A tri-level parking apparatus is provided. The apparatus includes a frame having a pair of spaced apart vertical stanchions. First and second parking platforms are disposed between the stanchions and can be slidably moved up or down along the stanchions. Piston/cylinder assemblies are provided for independently lifting the first parking platform from a lower position, to an intermediate position and ultimately to an uppermost position. Similarly, the piston/cylinder assemblies enable independent lifting of the lower platform from a lowermost position to the intermediate position.

22 Claims, 5 Drawing Sheets

TRI-LEVEL VEHICULAR PARKING APPARATUS

BACKGROUND OF THE INVENTION

Urban ares throughout the world continue to experience growth and a corresponding increase in vehicular traffic. The demand for office, commercial and residential space in urban areas often makes it economically impractical to maintain at-grade vehicular parking lots. In particular, owners of real estate often can make substantially more profit by developing their land with an appropriate building than they can by using the land as a parking lot. The construction of a building on the site of a former parking lot depletes the supply of at-grade parking spaces, and simultaneously increases the demand for such spaces in proportion to the traffic generated by the new building. Multilevel vehicular parking garages exist in most urban areas. However, structures of this type are expensive to build and operate.

Parking problems also exist for new or used car dealers and for operators of vehicular fleets. These businesses must have a parking capacity to meet their inventory or fleet needs. The costs associated with maintaining a large at-grade parking facility or a multi-level parking garage often will significantly erode the profits of such businesses.

Double-decked parking apparatuses have been available in the prior art. In particular, the prior art parking apparatus includes a platform onto which a vehicle may be driven. The apparatus further includes means for lifting the platform with the vehicle thereon a sufficient distance to enable a second car to be driven under the platform. Thus, the prior art parking apparatus enables two vehicles to be parked in an area approximately the size of a single parking space, and thereby approximately doubles the usage and efficiency of a parking area.

One very effective prior art parking apparatus is shown in U.S. Pat. No. 4,209,276 which issued to the inventor herein on June 24, 1980. The apparatus shown in U.S. Pat. No. 4,209,276 includes a generally horizontal platform that is disposed between a pair of upstanding stanchions. The platform can be selectively raised or lowered relative to the stanchions. The parking apparatus shown in U.S. Pat. No. 4,209,276 includes a pair of cylinders extending upwardly from the top of the stanchions, and pistons extending from the cylinders into engagement with the platform. The pistons are extended from the cylinders to lower the platform and are retracted into the cylinders to raise the platform. Although the parking apparatus of U.S. Pat. No. 4,209,276 is extremely effective, the apparatus defines a height substantially equal to the height of the stanchions plus the height of the cylinders. This overall height typically is 11 feet 4 inches and invariably is higher than the roof of a vehicle disposed on the elevated platform. The overall height of the apparatus shown in U.S. Pat. No. 4,209,276 often prevents using the apparatus in indoor parking facilities.

U.S. Pat. No. 4,772,172 also issued to the inventor herein and shows an improvement to the inventor's earlier U.S. Pat. No. 4,209,276. The apparatus shown in U.S. Pat. No. 4,772,172 includes a parking platform that is disposed between a pair of substantially vertical stanchions and that can be raised and lowered relative to those stanchions. Stabilizer bar assemblies are provided on each side of the parking platform. Each stabilizer bar assembly includes a rocker arm pivotably connected to the platform and a control arm pivotably connected to a base. The rocker arm and the control arm are further pivotably connected to one another. Thus, the stabilizer bar assembly effectively folds upon itself as the parking platform is lowered and expands as the parking platform is raised. A piston and cylinder assembly is pivotably connected to each stanchion and to the rocker arm. Movement of the piston in one direction causes the rocker arm to fold toward the control arm and thereby lowers the parking platform. Movement of the piston in the opposed direction causes the rocker arm to rotate away from the control arm, and elevates the parking platform. The apparatus shown in U.S. Pat. No. 4,772,172 achieves the desirable objective of combining the lifting and stabilizing functions of the parking apparatus, thereby substantially improving &:he stabilization of the apparatus. In this regard, it must be emphasized that stability is an extremely important requirement for a parking apparatus, since the apparatus must efficiently raise and lower a vehicle and steadily hold the vehicle in an elevated condition for hours on end. Furthermore, the weight and center of gravity of vehicles vary considerably, thereby making stability of the apparatus even more important. The maximum height of the apparatus shown in U.S. Pat. No. 4,772,172 generally will be defined by the roof of the vehicle parked on the platform, and typically will be between 9.5 and 10.0 feet. This is a significant improvement over the apparatus in U.S. Pat. No. 4,209,276 which defined a total height of 11 feet 4 inches. In view of this difference, the parking apparatus of U.S. Pat. No. 4,772,172 can be used in many indoor locations that were not available to its predecessor, as well as all outdoor parking lots.

The disclosures of U.S. Pat. No. 4,209,276 and U.S. Pat. No. 4,772,172 are incorporated herein by reference.

The above described prior art vehicular parking apparatus has achieved significant commercial acceptance and is available in urban areas throughout the world. However, even further parking efficiencies would be desirable. In this regard, a tri-level parking apparatus could offer such further efficiencies in the use of the limited land available for vehicular parking. More particularly, a tri-level parking apparatus could mean a fifty percent increase in revenues to the operator of a parking facility as compared to the above described prior art double-decked parking apparatus. Similarly, a tri-level parking apparatus can yield much more efficient use of space to car dealers and owners of vehicular fleets. However, stability becomes an even more important design consideration for tri-level parking apparatus.

One prior art tri-level parking apparatus is shown in U.S. Pat. No. 4,674,938 which issued to Van Stokes et al. on June 23, 1987. The apparatus, shown in U.S. Pat. No. 4,674,938 includes a large cumbersome frame having a complex arrangement of pulleys and straps that are intended to maintain stability as they lift the platforms from their lower positions to their respective elevated positions. In operation, upper and lower parking platforms shown in U.S. Pat. No. 4,674,938 are disposed in their respective lowermost positions and a vehicle is driven onto the upper platform. The upper platform is then lifted to a first elevated position which enables a vehicle to be driven onto the lower platform. The upper platform is raised again to a second elevated position. A strap extending between the upper and lower platforms causes the lower platform to be raised into the first elevated position as the upper platform is raised into the second elevated position. Thus, the movement of the upper platform from the first to the second elevated positions effectively pulls the lower platform upwardly. A third vehicle can then be driven under the lower parking platform. The complex arrangement of pulleys and straps prevents independent movement of the lower platform relative to the upper platform.

In view of the above, it is an object of the subject invention to provide an efficient tri-level vehicular parking apparatus.

It is another object of the subject invention to provide a tri-level vehicular parking apparatus that avoids complex arrangements of pulleys and straps.

It is a further object of the subject invention to provide a tri-level parking apparatus that enables entirely independent operation of the parking platforms thereof.

Still another object of the subject invention is to provide a tri-level parking apparatus that requires only approximately the space previously afforded to a bi-level parking apparatus.

Yet a further object of the subject invention is to provide an extremely stable tri-level parking apparatus.

SUMMARY OF THE INVENTION

The subject invention is directed to a tri-level parking apparatus having a pair of spaced apart stanchions extending upwardly from a base. The base may define a substantially horizontal support that can be placed upon the ground of an outdoor parking facility or the floor of an indoor parking facility In certain embodiments, however, the stanchions can be rigidly incorporated into the floor of a parking facility, thereby obviating the need for a separate base.

The parking apparatus further includes stabilization means for maintaining the stanchions substantially parallel to one another and in substantially vertical orientations. The stabilization means may include a gantry connecting the uppermost portions of the stanchions to one another. The stabilization means may further include at least one angle brace extending from an upper portion of each stanchion to the base.

The parking apparatus of the subject invention further includes a first or upper parking platform and a second or lower parking platform. The parking platforms are disposed between the stanchions and are selectively movable from lower positions adjacent the base to upper elevated positions as explained herein. The stable raising or lowering of the parking platforms may be achieved by frames which are movably engaged with the stanchions. More particularly, each parking platform may include a frame rigidly connected to the platform. Rollers are mounted to the frames and are engaged with the stanchions for smooth movement of the frames and the associated platforms upwardly and downwardly relative to the stanchions. The frame for the first or upper platform may include upper and lower separable portions. The upper portion of the frame for the first platform may stay in an intermediate position to support the stanchions and the elevating means as the first parking platform is moved to its lower position.

The parking platforms are configured to be placed in nested relationship to one another when they are both in their respective lowermost positions. The frames may also be nestable with one another. The nested arrangement enables a vehicle to be driven onto the first or upper platform when the upper platform is in its lowermost position and nested over the second or lower platform.

The parking apparatus of the subject invention further includes first and second elevating means for raising or lowering of the first and second platforms respectively. The first elevating means may be connected to the first parking platform and to the stanchion, gantry or other stationary part of the apparatus. The second elevating means similarly may be connected to the second parking platform and to the stanchion, gantry or the like.

The first elevating means may comprise two pairs of piston/cylinder assemblies, the cylinders of which are rigidly connected to one another. The first piston/cylinder assembly in each said pair may comprise a piston connected to a portion of the first parking platform and/or the support frame thereof. The second piston/-cylinder assembly in each said pair may have a piston connected to a portion of the stanchion or the rigid gantry connecting the stanchions. In operation, the extension of both pistons from their respective cylinders will cause the first platform to be in its lowermost position. Proper alignment and support for the slender fully extended piston/cylinder assemblies and for the stanchions may be achieved by the upper portion of the support frame for the first parking platform. The retraction of the first piston into the first cylinder will cause the first platform to be raised into a first elevated or intermediate position. The retraction of the second piston into the second cylinder will raise the first platform into its second elevated or upper position. This retraction of the second piston into its cylinder effectively raises the second cylinder and the entire first piston/cylinder assembly along with the first parking platform and the entire support frame thereof. The movement of the first parking platform into its second elevated or uppermost position is carried out entirely independently of an corresponding movement of the second parking platform.

A vehicle may be driven onto the second parking platform while the first parking platform is in either of its elevated positions. Once the first parking platform has been moved into its second elevated or uppermost position, a vehicle on the second parking platform may be raised to the first elevated or intermediate position. This movement of the second parking platform into the first elevated or intermediate position is carried out by a second elevating means which preferably comprises piston/cylinder assemblies. A preferred second elevating means may be the piston/cylinder assemblies shown in either U.S. Pat. No. 4,209,276 or in U.S. Pat. No. 4,772,172. However, an elevating means similar to that shown in U.S. Pat. No. 4,722,172 is preferred in view of the combination of the stabilizing and lifting functions as explained above.

Upon the elevation of the second parking platform into the second elevated or intermediate position, a third vehicle can be driven between the stanchions and underneath the second parking platform. As a result, the parking apparatus of the subject invention enables three vehicles to be parked in the space that normally would be allotted to a single vehicle.

Further economization of space can be provided by daisychaining a plurality of tri-level parking apparatuses of the subject invention. More particularly, a single stanchion can function to support two horizontally adjacent tri-level parking apparatuses, thereby obviating the need for two separate but substantially adjacent stanchions. This daisy-chained combination has been used in the prior art with the above described bi-level parking apparatus.

DETAILED DESCRIPTION OF THE PREFERRED EMBODIMENT

Figure 1:
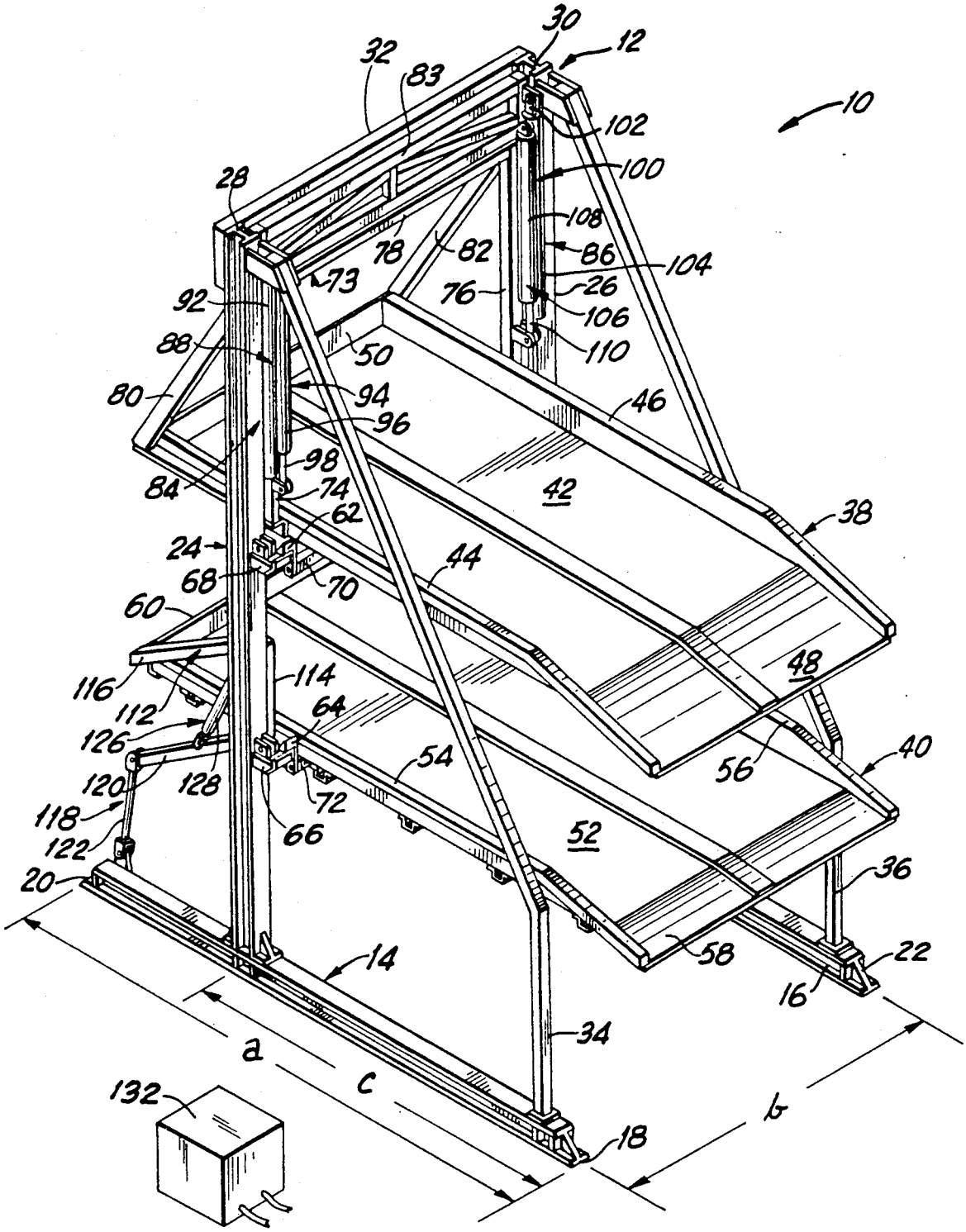
FIG. 1 is a perspective view of a parking apparatus in accordance with the subject invention.

The parking apparatus of the subject invention is identified generally by the numeral 10 in FIGS. 1–7. With reference to FIG. 1, the parking apparatus 10 includes a rigid supporting structure 12 having a base defined by first and second horizontal supports 14 and 16 respectively. The first horizontal support includes opposed front and rear ends 18 and 20 respectively, while the second horizontal support 16 includes a front end 22 and a rear end (not shown). The first and second horizontal supports 14 and 16 preferably are formed from steel wide flange beams of W6×25 dimension and preferably define lengths "a" of about 15.0 feet. Additionally, the first and second horizontal supports 14 and 16 are disposed at center-to-center spacing from one another of distance "b" which preferably is approximately 8.5 feet.

Figure 2:
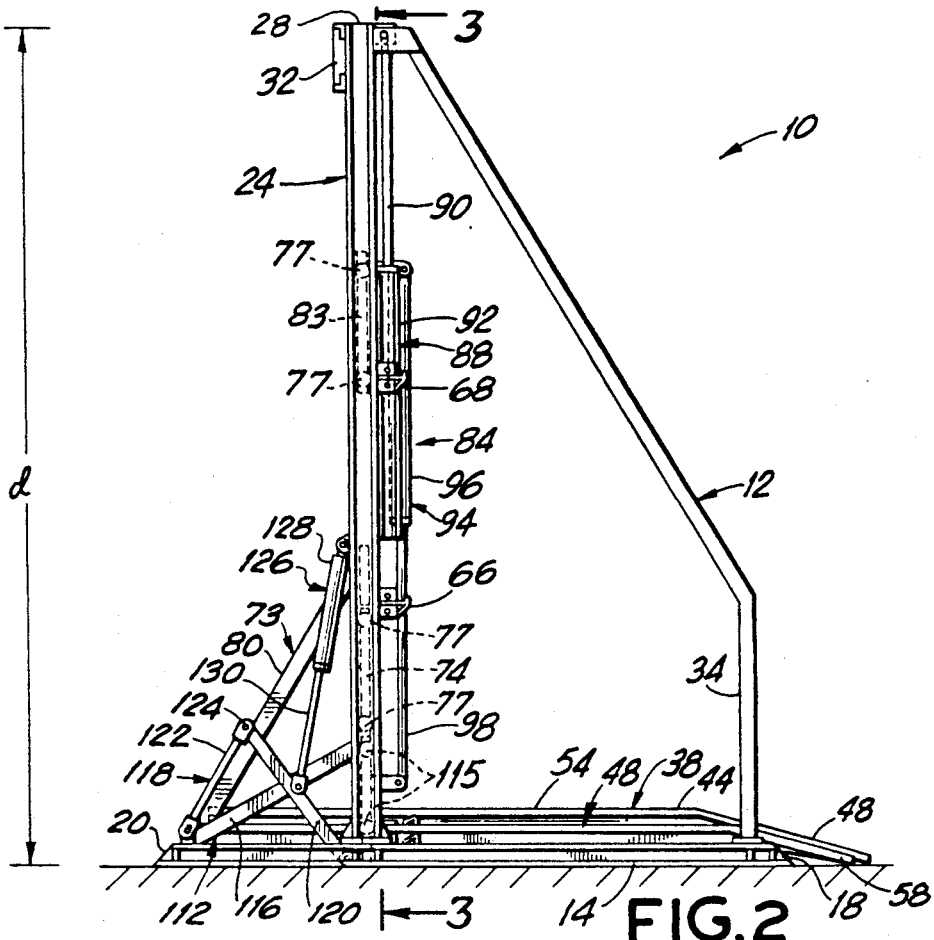
FIG. 2 is a side elevational view of the parking apparatus of FIG. 1 shown in a first operational condition.

The support structure 12 further includes first and second vertical stanchions 24 and 26 extending vertically upwardly from the first and second horizontal supports 14 and 16 respectively. The vertical stanchions 24 and 26 are rigidly connected to the corresponding horizontal supports 14 and 16 at locations intermediate the opposed ends of the horizontal supports 14 and 16, and preferably closer to the respective rear ends thereof. In particular, the vertical stanchions 24 and 26 may be disposed at distance "c" from the front ends 18 and 22 of the first and second horizontal supports 14 and 16 respectively where "c" is about ⅔ a, or 10.0 feet in the preferred embodiment. The first and second stanchions 24 and 26 preferably are formed from wide flange steel beams substantially identical to those of the first and second horizontal supports 14 and 16. Additionally, the first and second stanchions 24 and 26 include upper ends 28 and 30 which, as shown in FIG. 2, define an overall height "d" of the parking apparatus 10 which preferably is approximately 20.0 feet.

The support structure 12 further includes a horizontal fixed bridge 3 rigidly connecting the first and second stanchions 24 and 26 adjacent the top ends 28 and 30 thereof. The fixed bridge 32 functions to maintain a specified spaced relationship between the tops 28 and 30 of first and second stanchions 24 and 26. Preferably, the fixed bridge 32 comprises a pair of spaced apart horizontal supports, a central vertical support and a pair of diagonal supports. The truss-like configuration of the fixed bridge 32 helps to ensure parallel alignment between the first and second stanchions 24 and 26 and prevents vertical displacement of either stanchion 24 or 26 relative to the other.

The support structure 12 of the parking apparatus 10 further includes first and second front angle braces 34 and 36 respectively. The first front angle brace 34 extends from a location on the first stanchion 24 adjacent the top 28 thereof to a location on the first horizontal support 14 adjacent the front 18 thereof. Similarly, the second front angle brace 36 extends from a location on the second stanchion 26 adjacent the top end 30 thereof to a location on the second horizontal support 16 adjacent the front end 22 thereof. The spacing between the stanchions 24 and 26 and the angle braces 34 and 36 enables wide opening of the doors of a vehicle on the apparatus 10. The first and second front angle braces 34 and 36 preferably are made from a tubular steel stock approximately 3.5 inches square and formed from a steel material at least one-quarter inch thick. The nonlinear alignment of the angle braces 34 and 36 maximizes the distance between angle braces 34 and 36 and the stanchions 24 and 26 at locations near the horizontal supports 14 and 16. This configuration enables wide opening of doors of vehicles parked in the lower position.

Figure 6:
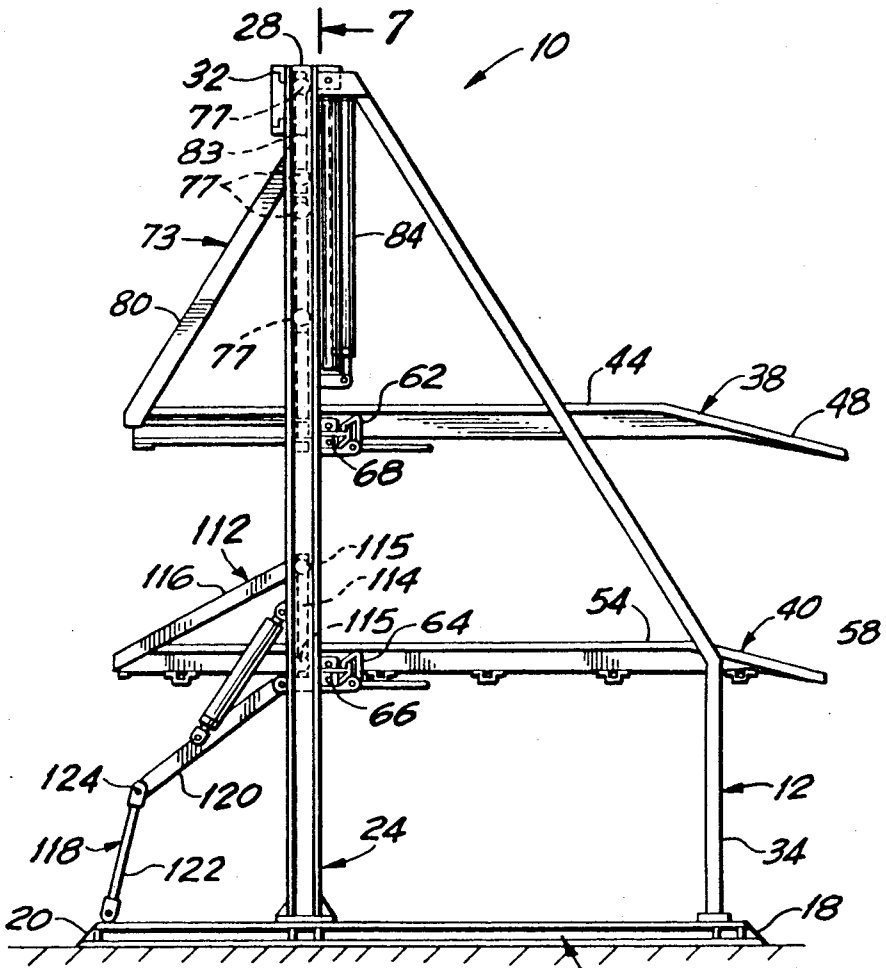
FIG. 6 is a side elevational view similar to FIGS. 2, 3 and 5 but showing the parking apparatus in a fourth operational condition which corresponds to the condition depicted in FIG. 1.

The parking apparatus 10 further includes first and second parking platforms 38 and 40 respectively. The first parking platform 38 defines the upper of the two platforms, and is dimensioned and configured to be nested over the second or lower parking platform 40 when both platforms are in their lowermost position relative to the support structure 12. More particularly, the first parking platform 38 includes a floor 42, first and second side rails 44 and 46, a front ramp 48 and a rear stop wall 50. Similarly, the second or lower parking platform 40 includes a floor 52, first and second side rails 54 and 56, a front ramp 58 and a rear stop wall 60. The front ramps 48 and 58 enable a vehicle to be driven onto the floors 42 and 52 of the respective platforms 38 and 40. The front ramp 48 of the first parking platform 38 projects forwardly beyond the front ramp 58 of the second parking platform 40 and projects downwardly a greater distance to ensure that the ramp 48 of the first parking platform 38 will be substantially abutting the surface o which the parking apparatus 10 is supported when both platforms 38 and 40 are in their lowermost position as shown most clearly in FIG. 2. Additionally, as shown in FIGS. 2 and 6, the side rails 44 and 46 and the rear stop wall 50 of the first parking platform 38 are disposed inwardly from the corresponding members 54, 56 and 60 of the second parking platform 40 to enable proper nesting of the parking platforms 38 and 40 in the lower position.

Figure 4:
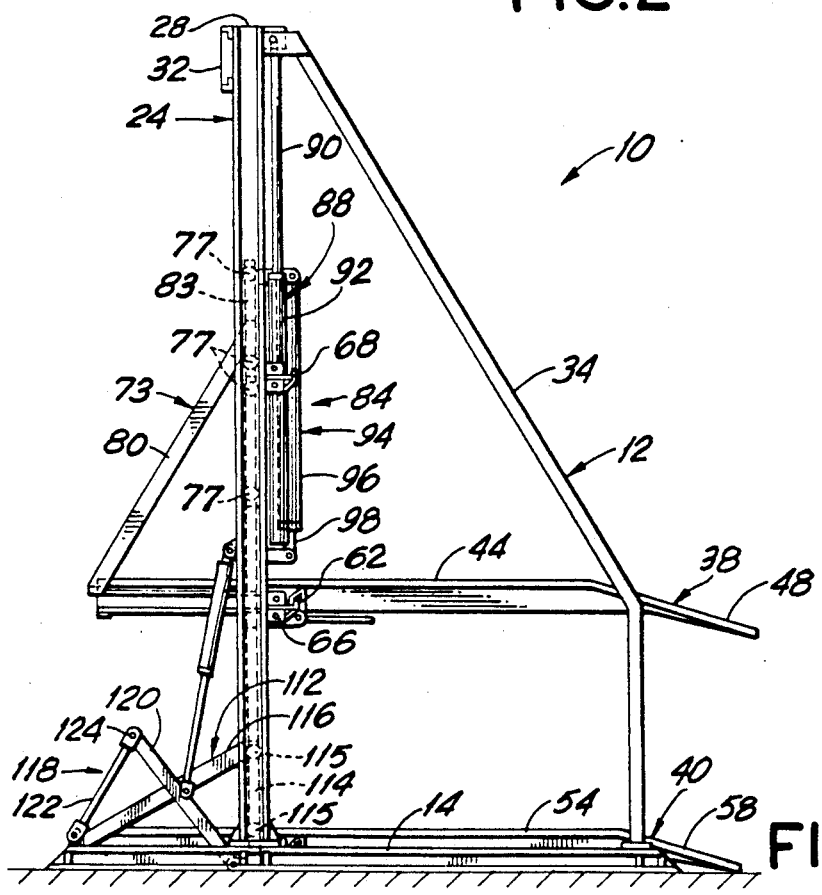
FIG. 4 is a side elevational view similar to FIG. 2 but showing the parking apparatus in a second operational condition.
Figure 5:
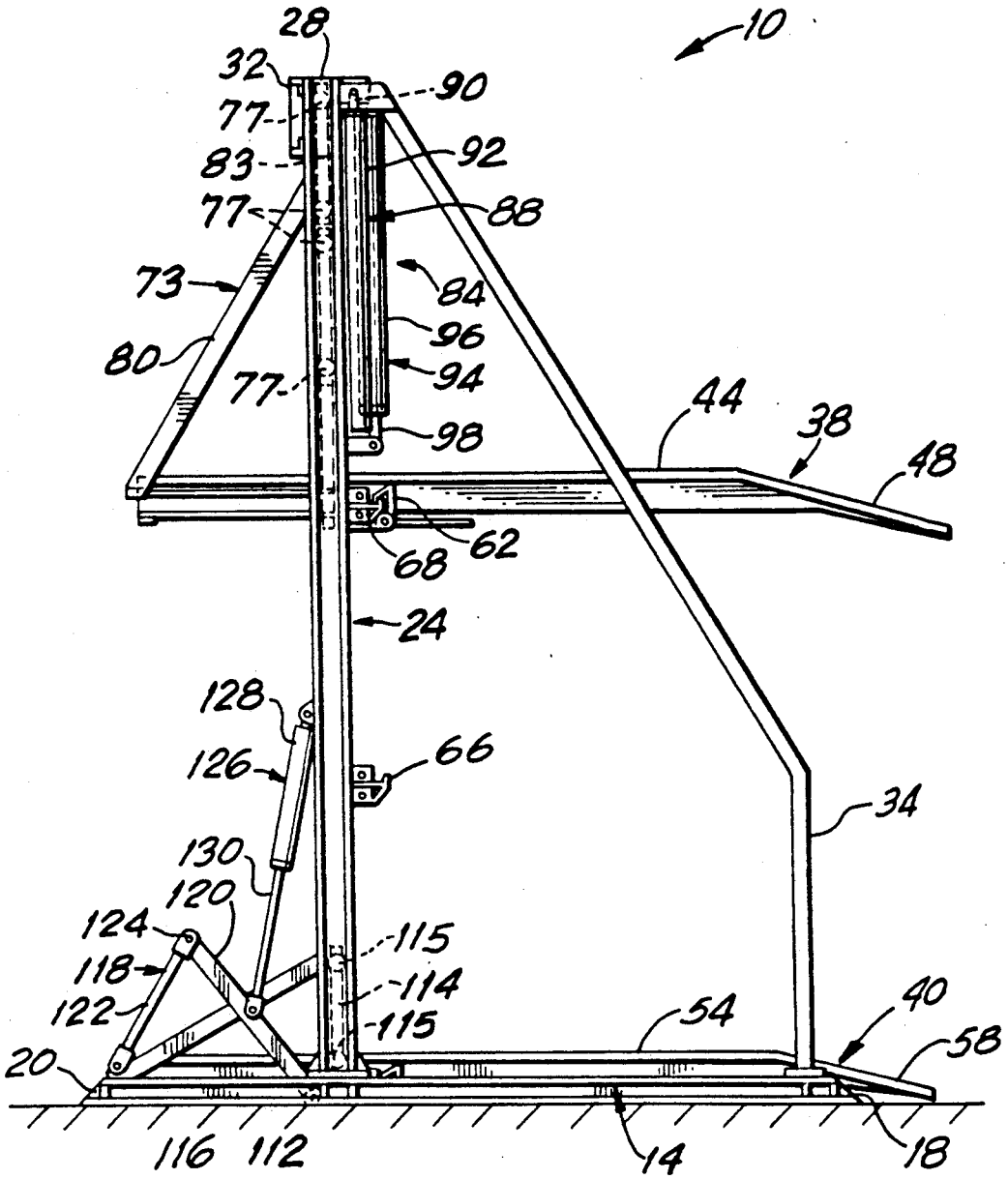
FIG. 5 is a side elevational view similar to FIGS. 2 and 4 but showing the parking apparatus in a third operational condition.
Figure 7:
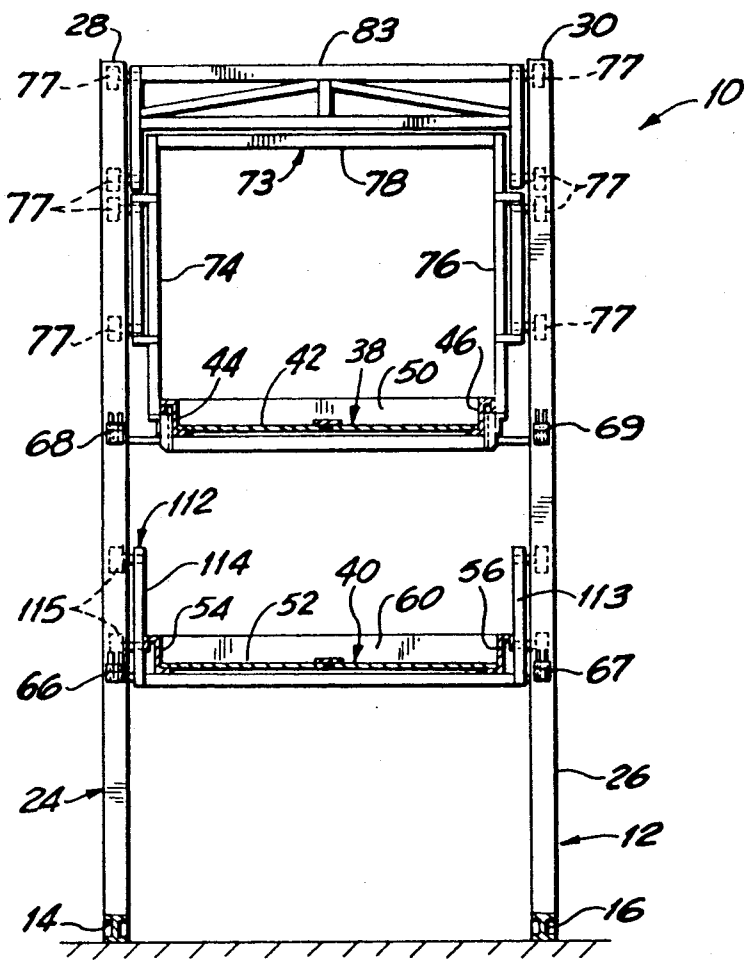
FIG. 7 is a cross-sectional view of the parking apparatus taken along line 7—7 in FIG. 6.

The first and second parking platforms 38 and 40 further include first and second locking latches 62 and 64 respectively which are selectively engageable with locking brackets 66 and 68 rigidly mounted to the first stanchion 24. Identical latches 63, 65 disposed adjacent the second side rails 46 and 56, as shown in FIG. 7, are engageable with corresponding brackets 67, 69 on the second stanchion 26. The latch pairs 62, 63 and 64, 65 are connected by safety bars 70 and 72 which extend under the floors 42, 52. The latches and the brackets are selectively operable to lockingly engage the first and second platforms 38 and 40 in selected elevational positions. More particularly, in a first or intermediate elevational position, the locking latches 62 and 63 of the first parking platform 38 may be engaged with the lower locking brackets 66 and 67, as shown in FIG. 4, and as explained further herein. However, the locking latches 62 and 63 of the first parking platform 38 may also be lockingly engaged with the upper locking brackets 68 and 69 in a second or uppermost elevated position as shown in FIGS. 5–7. The locking latches 64 and 65 of the second parking platform 40 are selectively engageable with the lower locking brackets 66 and 67 as shown in FIGS. 1, 6 and 7, but will not be raised to a position for engagement with the upper locking brackets 68 and 69 during normal operation of the apparatus 10.

Figure 3:
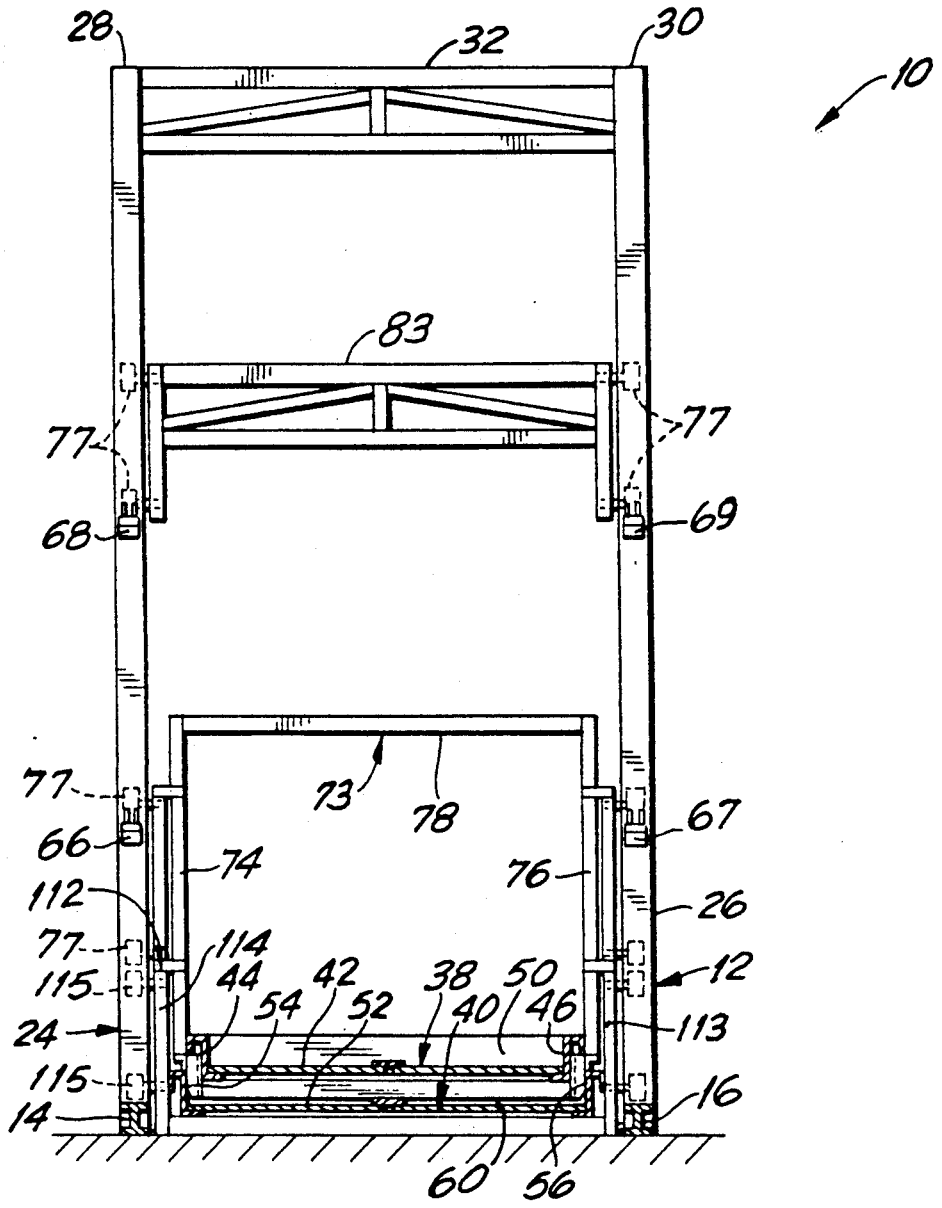
FIG. 3 is a cross-sectional view of the parking apparatus taken along line 3—3 of FIG. 2.

The first parking platform 38 further includes a stabilizing frame identified generally by the numeral 73. The stabilizing frame 73 includes first and second vertical supports 74 and 76 which extend vertically upwardly from opposed first and second side rails 44 and 46 of the first platform 38, and which include rollers 77 that are engaged with the first and second stanchions 24 and 26 respectively. The lower portions of the first and second vertical supports 74 and 76 are offset inwardly relative to the first and second stanchions 24 and 26, as shown in FIGS. 1, 3 and 7 to enable nesting with the corresponding supports of the second platform 40 as explained below. In particular, the rollers 77 are mounted to lateral extensions that nest over the frame of the second parking platform 40. The frame 73 further includes a horizontal support 78 extending between ends of the first and second vertical supports 74 and 76 remote from the first parking platform 38. The spacing between the horizontal support 78 and the floor 42 of the parking platform 38 preferably is 6 feet 5 inches to ensure adequate clearance for most vehicles that are likely to be driven onto the floor 42 of the first platform 38. The frame 73 further includes first and second rear angle braces 80 and 82 which extend from the respective intersections of the horizontal support 78 with the first and second vertical supports 74 and 76 to locations on the side rails 44 and 46 of the first parking platform 38 adjacent the rear stop wall 50 thereof. The frame 73 further includes a gantry 83 which is selectively separable from the remainder of the frame 73 and which includes an additional pair of rollers 77 on each side for rolling engagement with the respective stanchions 24 and 26. As will be explained further below, the gantry 83 contributes to the stability of the stanchions 24 and 26, the first parking platform 38 and the elevating means, as the first parking platform 38 is moved between its lower and intermediate positions The entire frame 73 ensures that the first parking platform 38 remains horizontal and properly aligned to the stanchions 24 and 26 through all ranges of movement.

The parking apparatus 10 further includes first and second pairs of piston/cylinder assemblies 84 and 86 for selectively lifting or lowering the first parking platform 38 independent of the second parking platform 40. The first pair of piston cylinder assemblies 84 comprises an upper piston/cylinder assembly 88 having a piston 90 pivotably connected to the first stanchion 24 adjacent the upper end 28 thereof. The upper piston cylinder assembly 88 further includes a cylinder 92 disposed below the piston 90 and connected to the gantry 83. As a result, the evacuation of hydraulic fluid from the cylinder 92 will cause the cylinder 92 and the gantry 83 to be moved upwardly toward the pivotable connection of the piston 90 with the top end 28 of the first stanchion 24. The first pair of piston/cylinder assemblies 84 further includes a lower piston/cylinder assembly 94 which comprises a cylinder 96 that is rigidly connected to the cylinder 92 and the gantry 83 and a piston 98 which projects downwardly from the cylinder 96. The piston 98 is pivotably connected to a portion of the first vertical support 84 of the frame 73. The frame 73, as explained above, is rigidly connected to the first parking platform 38. As a result, an evacuation of the hydraulic fluid from the cylinder 96 will pull the piston 98 upwardly into the cylinder 96 and will cause a corresponding lifting of the first parking platform 38 toward the gantry 83.

The second pair of piston/cylinder assemblies 86 is substantially identical to the first pair 84. More particularly, an upper piston/cylinder assembly 100 comprises a piston 102 connected to the upper end 30 of the second stanchion 26 and a cylinder 104 disposed downwardly therefrom and connected to the gantry 83. A lower piston/cylinder assembly 106 comprises a cylinder 108 rigidly connected to the cylinder 104 and the gantry 83, and a piston 110 projecting downwardly from the cylinder 108 and pivotably connected to the second vertical support 76 of the frame 73. The operation of the second pair of piston/cylinder assemblies 86 is substantially the same as the operation of the first pair 84 as explained above and further below.

The second parking platform 40 includes a first rear support frame 112, as shown most clearly in FIGS. 1, 2 and 4–6, and an identical second rear support frame 113 on the opposite side of the second platform 50, as shown in FIGS. 3 and 7. With reference to FIGS. 1, 2 and 4–6, the first rear support frame 112 comprises a vertical support 114 having rollers 115 engaged in the first stanchion 24 and an angle brace 116 extending from the upper end of the vertical support 114 to the intersection of the rear wall 60 with the side rails 54 and 56 of the second platform 40. The first rear support frame 112 and the second rear support frame 113 of the second platform 40 perform a stabilizing function similar to the function performed by the frame 73 of the first platform 38.

The apparatus 10 further includes a first stabilizer bar assembly 118 and an identical second stabilizer bar assembly (not shown) on the opposite side of the apparatus 10. The first stabilizer bar assembly 118 comprises a rocker arm 120 and a control arm 122 which is pivotably connected to the rocker arm 120 at pivot point 124. The rocker arm 120 is further pivotably connected to the second parking platform 40 substantially adjacent the lower end of the first vertical support 114 of the frame 112. The control arm 122 is further pivotably connected to the first horizontal support 14 substantially adjacent the rear end 20 thereof. The first stabilizer bar assembly 118 and the second stabilizer bar assembly (not shown) perform a stabilization function substantially comparable to the stabilizer bar assembly depicted in the above referenced U.S. Pat. No. 4,772,172.

The apparatus 10 further includes a piston/cylinder assembly 126 having a cylinder 128 pivotably connected to the first stanchion 24. A piston 130 is slidable into or out of the cylinder 128 in response to a controlled flow of hydraulic fluid, and is pivotably connected to the rocker arm 120. Preferably, the pivotable connection of the piston 130 to the rocker arm 120 is at a location closer to the stanchion 24 than to the pivotable connection of the rocker arm 120 to the control arm 122 to achieve greater mechanical advantage.

The apparatus 10 further includes hydraulic controller 132 for directing the flow of hydraulic fluid to the piston/cylinder assemblies. The controller includes switch means for preventing the movement of either parking platform 38 or 40 into the intermediate position until that position has been evacuated by the other platform. The hydraulic controller may further include a safety switch to automatically terminate operations of the apparatus 10 in response to a specified resistance indicative of a jam.

The operation of the apparatus 10 is illustrated most clearly in FIGS. 2 through 7. More particularly, with reference to FIG. 2, the piston 130 is extended from the cylinder 128 of the piston/cylinder assembly 126 to cause the rocker arm 120 to rotate about the pivot point 124 and toward the control rod 122. This extension of the piston 130 from the cylinder 128 causes the second parking platform 40 to be in the lowermost position as shown in FIGS. 2 and 3. Similarly, the pistons 90 and 98 of the upper and lower piston/cylinder assemblies 88 and 94 of the first pair 84 of piston/cylinder assemblies are extended. In a like manner, the pistons 102 and 110 of the upper and lower piston cylinder assemblies 100 and 106 in the second pair 86 also are extended. This extension of the pistons 90, 98, 102 and 110 causes the first parking platform 38 to be in its lower position. As shown most clearly in FIGS. 2 and 3, the first parking platform 38 is nested over and into the second parking platform 40. The longer length of the ramp 48 on the first parking platform 38 enables a vehicle to be driven onto the first parking platform 38. As shown most clearly in FIG. 3, the support frame 73 of the first parking platform 38 is nested over the support frames 112 and 113 of the second parking platform 40.

Referring to FIG. 4, the first parking platform 38 can be raised to a first elevated position by withdrawing the lower pistons 98 and 110 into the corresponding cylinders 96 and 108. This effectively pulls the horizontal member 78 of the frame 73 up to the gantry 83. In this first elevated position, the locking latches 62 and 63 of the first parking platform 38 lockingly engage with the lower locking brackets 66 and 67. Additionally, in this elevated position, a second vehicle can be driven onto the second parking platform 40.

Referring to FIG. 5, the first parking platform 38 may be raised into an upper position by evacuating the hydraulic fluid from the cylinders 92 and 104, thereby causing the cylinders 82 and 94 to be lifted upwardly, while simultaneously lifting the entire first parking platform 38, including the frame 73 and the gantry 83, up to the uppermost position. In this position, as shown in FIG. 5, the locking latches 62 and 63 engage with the upper locking brackets 68 and 69.

Referring to FIGS. 1, 6 and 7, the hydraulic fluid may be evacuated from the cylinder 128 of the piston/cylinder assembly 126, thereby causing the piston 130 to be retracted into the cylinder 128. This retraction of the piston 128 causes the rocker arm 120 to rotate about the pivot point 124 relative to the control arm 122 and simultaneously lifts the second parking platform 40 a sufficient distance to enable a vehicle to be driven underneath the second parking platform 40 and intermediate the first and second horizontal supports 14 and 16. In this position, as shown in FIGS. 1, 6 and 7, a clearance of approximately 5 feet 7 inches exists between the first and second parking platforms 38 and 40 and between the second parking platform 40 and the support on which the apparatus 10 is disposed.

The apparatus 10 can be collapsed to remove cars therefrom by reversing the steps described above, and ultimately returning the apparatus 10 to the FIGS. 2 and 3 condition.

In summary, a tri-level vehicular parking apparatus is provided including a frame having opposed first and second vertical stanchions. First and second parking platforms are disposed between the stanchions and can be selectively and independently raised and lowered along the stanchions. The first or upper parking platform may be raised by first and second pairs of piston/cylinder assemblies. The second or lower parking platform may be raised by a pair of piston/cylinder assemblies acting on a stabilizer bar assembly. The frame of the parking apparatus preferably includes a pair of front angle braces to support the stanchions relative to horizontal supports of the apparatus. The first and second parking platforms may further include rear support frames for further stabilization.

While the invention has been described with respect to a preferred embodiment, it is apparent that various changes can be made without departing from the scope of the invention as defined by the appended claims.

I claim:

1. A tri-level vehicular parking apparatus comprising:

a base comprising opposed forward and rearward ends;

first and second stanchions mounted to said base at locations thereon closer to the rearward end thereof than to the forward end of said base and extending upwardly therefrom;

first and second angle braces extending from locations on the respective first and second stanchions remote from the base to locations on the base in proximity to the forward end thereof, said angle braces being disposed and configured to enable opening of a door of a vehicle parked adjacent said base;

first and second vehicular parking platforms disposed intermediate the stanchions, each said parking platform including a forward end extending forwardly of said stanchions and a rearward end extending rearwardly of said stanchions, said parking platforms being independently movable from positions generally adjacent the base where the first parking platform is nested over the second parking platform to positions spaced from the base;

first and second frame means connected to the respective first and second parking platforms and movably engaged with the stanchions for maintaining said first and second parking platforms in substantially horizontal respective alignments at locations intermediate the stanchions and spaced from the base each said frame means comprising a pair of vertical supports rigidly connected to the respective parking platform and movably engaged with an associated one of said stanchions, said first and second frame means each further comprising a pair of diagonal supports connected to the corresponding vertical support at locations thereon remote from the respective first and second parking platforms and extending to locations on the respective first and second parking platforms in proximity to the rearward ends thereof; and first and second elevating means for selectively moving the respective first and second parking platforms and the respective first and second frame means alternately toward and away from said base, whereby said first parking platform can be moved selectively to intermediate and upper elevated positions spaced from said base, and whereby said second parking platform can be moved to the intermediate position when the first parking platform is in the upper position such that a first vehicle can be parked on the first parking platform in the upper position, a second vehicle can be parked on the second parking platform in the intermediate position and a third vehicle can be parked beneath the second parking platform.

2. A parking apparatus as in claim 1 wherein the first and second frame means are nestable with one another when the respective first and second platforms are in lower positions adjacent to said base.

3. A parking apparatus as in claim 1 wherein the first parking platform further includes a horizontal support extending between and rigidly connecting the spaced apart vertical supports, said horizontal support being spaced from the parking platform a distance sufficient to enable the first vehicle to be driven intermediate the horizontal support and the first parking platform.

4. A parking apparatus as in claim 3 wherein the vertical supports of the first frame means are disposed intermediate the vertical supports of the second frame means, said first frame means further comprising lateral extension means extending from said vertical support means into moving engagement with the stanchion for enabling nesting of the first and second parking platforms and the first and second frame means when the first and second parking platforms are disposed substantially adjacent the base.

5. A parking apparatus as in claim 1 wherein the first and second frame means each comprise at least first and second pairs of rollers for movably engaging the frame means with the first and second stanchions respectively.

6. A parking apparatus as in claim 5 wherein the first and second stanchions each comprise vertically extending channels therein for receiving and engaging the rollers of the first and second frame means.

7. A parking apparatus as in claim 1 further comprising first and second stabilizer bar assemblies extending between opposite sides of said second parking platform and the base, each said stabilizer bar assembly comprising a rocker arm pivotably connected to the first parking platform and a control arm having a first end pivotably connected to the rocker arm and a second end pivotably connected to the base.

8. A parking apparatus as in claim 7 wherein the second elevating means comprises first and second piston/cylinder assemblies extending between the respective first and second stanchions and the respective first and second stabilizer bar assemblies, said piston/cylinder assemblies being operative to alternately collapse and extend the stabilizer bar assemblies for selectively moving the second parking platform toward and away from the base.

9. A parking apparatus as in claim 1 further comprising a bridge rigidly connecting the stanchions at locations thereon remote from the base for supporting said stanchions relative to one another.

10. A parking apparatus as in claim 1 wherein the base comprises first and second spaced apart horizontal supports, said stanchions being rigidly connected to said horizontal supports.

11. A parking apparatus for parking first, second and third vehicles, said parking apparatus comprising:

a base;

first and second stanchions rigidly connected to said base and extending upwardly therefrom;

first and second parking platforms disposed intermediate said first and second stanchions said first parking platform being nestable over the second parking platform in positions of said platforms adjacent the base, said first and second parking platforms each including a support frame comprising first and second vertical supports extending upwardly from the respective parking platform and into rolling engagement with the respective first and second stanchions, said frames being dimensioned to be nested with one another when the first and second parking platforms are nested adjacent the base; and first and second elevating means extending between said stanchions and the respective first and second parking platforms for independently moving the respective first and second parking platforms along said stanchions selectively toward and away from the base, whereby said first parking platform is selectively movable by said first elevating means to an intermediate position on said stanchions and an upper position on said stanchions, and whereby the second parking platform is selectively movable by the second elevating means to the intermediate position on said stanchions such that said first vehicle can be parked on said first platform in the upper position while the second vehicle is parked on the second parking platform in the intermediate position and the third vehicle is parked intermediate the stanchions and under the second parking platform.

12. A parking apparatus as in claim 11 further comprising first and second stabilizer bar assemblies extending between the second parking platform and the base, each said stabilizer bar assembly comprising a rocker arm pivotably connected to the second parking platform, a control arm having opposed ends, one end of said control arm being pivotably connected to the rocker arm and the other end of the control arm being pivotably connected to the base, said stabilizer bar assemblies ensuring horizontal movement of the second parking platform along said stanchions.

13. A parking apparatus as in claim 12 wherein the second elevating means comprises first and second piston/cylinder assemblies extending between the first and second stanchions respectively and the first and second respective stabilizer bar assemblies.

14. A parking apparatus as in claim 12 wherein the first and second piston/cylinder assemblies are pivotably connected to the first and second stabilizer bar assemblies at locations on the respective rocker arms thereof intermediate the associated stanchion and the associated control arm.

15. A parking apparatus as in claim 11 wherein the frame of the first parking platform comprises a horizontal support extending rigidly between the vertical supports thereof at locations permitting the first vehicle to be driven onto the first parking platform and under the horizontal support thereof.

16. A parking apparatus comprising:

a base;

first and second stanchions rigidly connected to said base and extending upwardly therefrom;

first and second parking platforms disposed intermediate said stanchions with the first parking platform being nestable over the second parking platform at locations of said platforms adjacent said base, said parking platforms being independently movable away from said base;

a gantry movably engaged with said stanchions and disposed in spaced relationship above the first parking platform;

a first elevating means engaged with said stanchions, said gantry and said first parking platform, said first elevating means being operative to move the first parking platform toward the gantry and to independently move the gantry and the first parking platform away from the base; and a second elevating means independent of said first elevating means for moving said second parking platform away from said base.

17. A parking apparatus as in claim 16 wherein the first elevating means comprises first and second pairs of piston/cylinder assemblies, each said pair of piston/cylinder assemblies comprising a lower piston/cylinder assembly for moving the first parking platform toward and away from the gantry and an upper piston/cylinder assembly for moving the gantry and the first parking platform to locations on said stanchions remote from said base.

18. A tri-level vehicular parking apparatus comprising:

a base;

first and second stanchions mounted to said base and extending upwardly therefrom;

first and second vehicular parking platforms disposed intermediate the stanchions, said parking platforms being independently movable from positions generally adjacent the base where the first parking platform is nested over the second parking platform to positions spaced from the base;

first and second frame means connected to the respective first and second parking platforms for maintaining said first and second parking platforms in substantially horizontal respective alignments at locations intermediate the stanchions and spaced from the base, the first and second frame means each comprising a pair of vertical supports rigidly connected to the respective first and second parking platforms and movably engaged with an associated one of said stanchions, said first and second frames each further comprising diagonal support means connected to the vertical support means at locations thereon remote from the respective first and second parking platforms and extending to locations on the respective first and second parking platforms remote from said stanchions, the first parking platform further including a horizontal support extending between and rigidly connecting the spaced apart vertical supports, said horizontal support being spaced from the parking platform a distance sufficient to enable the first vehicle to be driven intermediate the horizontal support and the first parking platform, the vertical supports of the first frame means being disposed intermediate the vertical supports of the second frame means, said first frame means further comprising lateral extension means extending from said vertical support means into moving engagement with the stanchion for enabling nesting of the first and second parking platforms and the first and second frame means when the first and second parking platforms are disposed substantially adjacent the base; and first and second elevating means for selectively moving the respective first and second parking platforms and the respective first and second frame means alternately toward and away from said base, whereby said first parking platform can be moved selectively to intermediate and upper elevated positions spaced from said base, and whereby said second parking platform can be moved to the intermediate position when the first parking platform is in the upper position such that a first vehicle can be parked on the first parking platform in the upper position, a second vehicle can be parked on the second parking platform in the intermediate position and a third vehicle can be parked beneath the second parking platform.

19. A tri-level vehicular parking apparatus comprising:

a base;

first and second stanchions mounted to said base and extending upwardly therefrom;

first and second vehicular parking platforms disposed intermediate the stanchions, said parking platforms being independently movable from positions generally adjacent the base where the first parking platform is nested over the second parking platform to positions spaced from the base;

first and second frame means connected to the respective first and second parking platforms and movably engaged with the stanchions for maintaining said first and second parking platforms in substantially horizontal respective alignments at locations intermediate the stanchions and spaced from the base; and first and second elevating means for selectively moving the respective first and second parking platforms and the respective first and second frame means alternately toward and away from said base, the first elevating means comprises first and second pairs of piston/cylinder assemblies, one piston/cylinder assembly in each said pair being connected to a portion of the respective one of said first and second stanchions remote from the base, the other piston/cylinder assembly in each said pair being connected to the first frame means, each said pair of piston/cylinder assemblies comprising a pair of cylinders rigidly connected to one another such that the first piston/cylinder assembly in each said pair is operative to move the first parking platform between a lower position adjacent the base and an intermediate position, and such that the second piston/cylinder assembly in each said pair is operative to move the first parking platform between the intermediate position and an upper position, whereby said first parking platform can be moved selectively to intermediate and upper elevated positions spaced from said base, and whereby said second parking platform can be moved to the intermediate position when the first parking platform is in the upper position such that a first vehicle can be parked on the first parking platform in the upper position, a second vehicle can be parked on the second parking platform in the intermediate position and a third vehicle can be parked beneath the second parking platform.

20. A parking apparatus for parking first, second and third vehicles, said parking apparatus comprising:

a base;

first and second stanchions rigidly connected to said base and extending upwardly therefrom;

first and second parking platforms disposed intermediate said first and second stanchions said first parking platform being nestable over the second parking platform in positions of said platforms adjacent the base, said first and second parking platforms each including a support frame comprising first and second vertical supports extending upwardly from the respective parking platform and into rolling engagement with the respective first and second stanchions, said frames being dimensioned to be nested with one another when the first and second parking platforms are nested adjacent the base; and first and second elevating means extending between said stanchions and the respective first and second parking platforms for independently moving the respective first and second parking platforms along said stanchions selectively toward and away from the base, the first elevating means comprises first and second pairs of piston/cylinder assemblies extending between the first parking platform and locations on the respective first and second stanchions remote from the base, each said pair of piston/cylinder assemblies comprising a cylinder, with the cylinders in each said pair being rigidly connected to one another, one piston/cylinder assembly in each said pair being selectively operable to move the first parking platform from a lower position adjacent the base to an intermediate position, the other piston/cylinder assembly of each said pair being operative to move the first parking platform between the intermediate position and an upper position, whereby the second parking platform is selectively movable by the second elevating means to the intermediate position on said stanchions such that said first vehicle can be parked on said first platform in the upper position while the second vehicle is parked on the second parking platform in the intermediate position and the third vehicle is parked intermediate the stanchions and under the second parking platform.

21. A parking apparatus as in claim 20 wherein the first parking platform further comprises a gantry in rolling engagement with the stanchions and being rigidly connected to a portion of said first elevating means.

22. A parking apparatus as in claim 21 wherein the gantry is rigidly connected to the cylinders of the first elevating means.

* * * * *